US012674331B2

(12) United States Patent
Lin et al.

(10) Patent No.: US 12,674,331 B2
(45) Date of Patent: Jul. 7, 2026

(54) RAISED FLOOR AND ASSEMBLING METHOD THEREOF

(71) Applicant: Anhui Coordinated Lin Plastic Technology Co., Ltd., Hefei (CN)

(72) Inventors: Chao Lin, Hefei (CN); Xuanyu Lin, Hefei (CN); Xuanqi Lin, Hefei (CN); Yumo Lin, Hefei (CN)

(73) Assignee: Anhui Coordinated Lin Plastic Technology Co., Ltd., Hefei (CN)

( * ) Notice: Subject to any disclaimer, the term of this patent is extended or adjusted under 35 U.S.C. 154(b) by 310 days.

(21) Appl. No.: 18/344,600

(22) Filed: Jun. 29, 2023

(65) Prior Publication Data

US 2024/0044151 A1 Feb. 8, 2024

(30) Foreign Application Priority Data

Aug. 8, 2022 (CN) ..... 202210947939.3

(51) Int. Cl.
*E04F 15/024* (2006.01)

(52) U.S. Cl.
CPC .. *E04F 15/02476* (2013.01); *E04F 15/02405* (2013.01); *E04F 15/02452* (2013.01); *E04F 2201/0146* (2013.01); *E04F 2201/0153* (2013.01); *E04F 2201/023* (2013.01); *E04F 2201/043* (2013.01); *E04F 2201/044* (2013.01)

(58) Field of Classification Search
CPC ..... E04F 15/02464; E04F 15/02476; E04F 15/02405; E04F 15/02447; E04F 15/02452; E04F 15/02458; E04F 2201/0146; E04F 2201/0153; E04F 2201/023; E04F 2201/043; E04F 2201/044
See application file for complete search history.

(56) References Cited

U.S. PATENT DOCUMENTS 5,398,466 A * 3/1995 Oyama ..... E04F 15/02458 52/126.6
5,791,096 A * 8/1998 Chen ..... E04F 15/02452 52/220.1
7,509,782 B2 * 3/2009 Colosimo ..... E04F 19/08 52/126.6

(Continued)

FOREIGN PATENT DOCUMENTS

CN 105888191 B 2/2018

*Primary Examiner* — Chi Q Nguyen
(74) *Attorney, Agent, or Firm* — MUNCY, GEISSLER, OLDS & LOWE, P.C.

(57) ABSTRACT

A raised floor and an assembling method thereof includes a plurality of raised floor boards, wherein a plurality of raised floor boards are assembled and connected to form an integrated floor, an edge of the integrated floor close to the wall is supported by a leveling beam, and leveling screws are arranged below connecting positions of two adjacent raised floor boards, a reserved expansion joint is arranged between the edge of the integrated floor and the wall, and a position above the integrated floor close to the wall is fixedly connected with frame beam by an expansion screw. An edge of the raised floor board body structure is processed, so that the raised floor boards can be assembled through lap joint and connection of structures, and supported through the leveling screws when they are in mutually lap joint for assembly.

4 Claims, 9 Drawing Sheets

(56) References Cited

U.S. PATENT DOCUMENTS

| | | | | |
|---|---|---|---|---|
| 7,770,345 | B2 * | 8/2010 | McConnell | E04F 15/02429 52/126.6 |
| 8,002,943 | B2 * | 8/2011 | Brown | B28B 11/0845 52/747.11 |
| 8,898,999 | B1 * | 12/2014 | Kugler | E04F 15/02464 52/126.6 |
| 9,874,029 | B2 * | 1/2018 | Kugler | E04F 15/02494 |
| 9,879,385 | B2 * | 1/2018 | Tabibnia | E04F 15/02452 |
| 9,982,439 | B2 * | 5/2018 | Essig | E04F 15/02405 |
| 10,844,613 | B2 * | 11/2020 | Repasky | E04D 11/007 |
| 11,168,447 | B2 * | 11/2021 | Repasky | E04F 15/0247 |
| 11,408,132 | B2 * | 8/2022 | Logan | H05B 1/0227 |
| 2002/0194801 | A1 * | 12/2002 | Jette | E04F 15/02458 52/220.8 |

* cited by examiner

RAISED FLOOR AND ASSEMBLING METHOD THEREOF

TECHNICAL FIELD

The present invention relates to the technical field of fabricated floors, in more particularly to a raised floor and an assembling method thereof.

BACKGROUND ART

Construction industry is used as the pillar industry of national economy, and the total output value has reached more than 20% of the GDP, while the energy consumption of the building accounts for 32% of the total energy consumption of the country, which is the highest single energy consumption industry. The conditions of high energy consumption, high pollution and low output of the construction industry need to be changed, and the development path of novel building industrialization and informatization (a combination of the two-factors) must be innovated through technical innovation, and in this trend, the building production necessarily needs to start from factory, and the fabricated concrete building becomes a necessary direction. Compared with a traditional building, the fabricated building changes a traditional manufacturing mode, and through standardized design, industrial production, mechanized construction and installation, and changing wet operation operation to dry operation, the building quality is guaranteed, the labor intensity is relieved, the production cost is reduced, environmental pollution is reduced, and natural resources are saved.

The patent application with publication No. CN105888191B discloses a kind of network raised floor, comprising: a first support portion, wherein the first support portion being used for bearing a vertex angle of the floor unit, and the first support portion being provided with a plurality of vertically through threaded holes; a limiting portion, the plurality of limiting portions being distributed around the first support portion and being fixedly connected to the first support portion, and the limiting portion being used for transversely positioning two adjacent flanges in a horizontal plane; the support head used by the network raised unit is simple in structure, it is guaranteed that the product is not prone to aging in long-term use under the condition that the production cost is kept low, complete fireproof is achieved, and potential safety hazards are eradicated; and in addition, due to the fact that the support head is not a plastic piece, a threaded hole can be formed, the vertex angle of the floor unit is supported on the support head and is fixed by the threaded hole, so that the laid raised floor is more stable in structure, does not generate violent rebound due to vibration, and prevents abnormal sound.

However, there are still many disadvantages in practical use,

1. The support head of the raised floor needs to be provided with a threaded hole through the drill bit, so that a set of process is added, the time consumed during installation is large, and the cost is high;
2. The weight of the support head is high, so that the cost is increased for transportation, and the installed raised floor needs to be disassembled more and is not convenient enough;
3. The parts forming the raised floor are significant, and the integrated structure of the installed bottom plate itself is large, causing the actual weight borne by the upper side of the raised floor to be lowered.

To this end, we propose the raised floor and an assembling method thereof to solve the above-mentioned problems.

SUMMARY OF THE INVENTION

In order to overcome the above-mentioned defects in the prior art, the embodiments of the present invention provide a raised floor and an assembling method thereof for processing an edge of the raised floor board body structure, so that the raised floor boards can be assembled through lap joint and connection of structures, the raised floor boards are supported through the leveling screws when they are in mutually lap joint for assembly, the number of lap joint components is reduced, and a multi-foot position of the bottom plate is supported by the leveling screws, so that bearing weight borne by the whole raised floor is evenly distributed on the multiple screws, so that the pressure borne by each leveling screw and the raised floor board is small, so as to solve the problems proposed in the background art.

In order to achieve the above object, the present invention provides the following technical solutions: a raised floor comprises a plurality of raised floor boards, wherein a plurality of raised floor boards are assembled and connected to form an integrated floor, an edge of the integrated floor close to the wall is supported by a leveling beam, the leveling beam is configured to be fixed on the wall by an expansion screw, and leveling screws are arranged below connecting positions of two adjacent raised floor boards, a reserved expansion joint is arranged between the edge of the integrated floor and the wall, and a position above the integrated floor close to the wall is fixedly connected with frame beam by an expansion screw, a leveling gasket is arranged between the frame beam and the wall, skirting buckle is installed on the other side of the frame beam; skirting line is arranged on one side of the skirting buckle; a wallboard is installed above the skirting buckle.

In one preferred embodiment, one end portion of each of the raised floor boards in a vertical direction is arranged with a first lap joint block, the other end portion of each of the raised floor boards in a vertical direction is arranged with a second lap joint block, the first lap joint block is in a lap joint with the second lap joint block, and the same column of the raised floor boards is assembled through the lap joint formed between the first lap joint block and the second lap joint block; and a first connecting block is arranged at one end portion of each of the raised floor boards in a horizontal direction, a connecting gap chamber is arranged in one side of the first connecting block, a second connecting block is arranged at the other end portion of each of the raised floor boards in the horizontal direction, a mounting clamping strip is embedded in the connecting gap chamber, and every two adjacent raised floor boards in a same horizontal direction are connected through the first connecting block and the second connecting block which are connected with each other.

In one preferred embodiment, positions of the raised floor boards are provided with preformed holes at positions of the leveling screws, and an outer side of the preformed holes is provided with a plurality of sockets.

In one preferred embodiment, after each of the raised floor boards are assembled into an integrated floor, the preformed holes located at the positions of the same leveling screws form a circular chamber, and the sockets are distributed around the preformed holes.

In one preferred embodiment, each of the leveling screws comprises a support plate, a support column and a support base, the support plate is in contact with a bottom wall of each of the raised floor boards; a support hole penetrates through the support plate for accommodating the support column, the inner side wall of the support hole is provided with an internal thread; an outer side of the support column is provided with an external thread; the support column and the support plate are lifted through the internal thread and the external thread which cooperate with each other, an interior of the support column is hollow to form a cross-shaped chamber, and a bottom end of the support column is inserted into the support base to be assembled integrally with the support base.

In one preferred embodiment, a top end of the support plate is connected with an insertion rod at a position corresponding to each of the sockets, a top end of the insertion rod is connected with a circular truncated cone block, and an outer diameter of the insertion rod is equal to an inner diameter of each of the sockets.

A method of assembling a raised floor, comprising the following steps: Step: cleaning a base layer: preparing, classifying, placing and keeping clean construction tools, construction materials such as floor boards and a support leg, and simultaneously clearing garbage and dust on the ground, and leveling the ground; Step: laying down a horizontal line: before assembly, planning height of the raised floor according to the environment of the construction site and the use requirement, and then snap-lining through an ink fountain, and forming a horizontal line at an installed position, namely, a floor laying baseline; Step: installing the beams: respectively installing the leveling beam and the frame beam; Step: installing the leveling support leg: finding positions corresponding to the preformed holes according to the size of the raised floor, and arranging the leveling screws at the positions, so as to fix a support point of the floor board, and adjusting all the leveling screws to the height approximately equal to a top end of the leveling beam; and Step: laying the floor board, laying the raised floor boards, laying the floor board along the floor laying baseline, laying the raised floor boards close to the positions of the leveling beam, and leaving the reserved expansion joint so as to prevent the floor board from cracking or damaging its integrated structure due to climate and temperature changes, after laying the bottom plate close to the leveling beam, laying it continuously with the raised floor boards, inserting the insertion rod in the leveling screws into the sockets, support and fixing the raised floor boards through the leveling screws, and keeping the preformed holes above the leveling screws (3), and finely adjusting the height of the leveling screws with the tools.

In one preferred embodiment, specific steps of installing the leveling beam in the step are as follows: the leveling beam is calibrated by using a laser level gauge to ensure that the horizontal misalignment of the floor over a three meters range does not exceed 0.5 mm, and the misalignment of the whole raised floor does not exceed 2 mm, and the leveling beam is attached to the wall during installation, the bottom end of the leveling beam is in contact with the ground when installing, the top end thereof is flush with the horizontal line, and then the leveling beam is fixed on the wall through the expansion screw, so as to fix the leveling beam;

specific steps of installing the frame beam in step 3 are as follows: Step-: installing a leveling gasket, first attaching the leveling gasket to the wall according to actual height of skirting line, and then fixing the leveling gasket on the wall through the expansion screw; and Step-: installing the frame beam, providing the frame beam according to the height of the skirting line, and placing the frame beam close to the leveling gasket to form a bottom frame of wallboard.

In one preferred embodiment, it further comprises a step: installing the wallboard, wherein specific installing steps are as follows: Step-: installing the skirting line, attaching the skirting line to the frame beam, and installing the skirting line on the frame beam through skirting buckle, thereby forming the skirting line of fabricated wallboard; and Step-: installing the wallboard, installing the wallboard above the skirting buckle, and fixing a bottom end of the wallboard through a gap chamber formed by the skirting line and the frame beam.

In one preferred embodiment, specific operation of finely adjusting the height of the leveling screws through the tools in the step is as follows: twisting the support column, and inserting a turning handle with a geometric shape in cross section into the cross chamber inside the support column, twisting the turning handle to cause the support column to rotate, and changing the height of the support plate through cooperation of the internal thread and the external thread, and finely adjusting the height of the support plate so that the support plate maintains the same height as the top of the leveling beam, and keeping the height of the raised floor boards consistent.

The technical effects and advantages of the present invention are as follows:

1. Compared with the existing raised floor, the fabricated floor designed by the present invention realizes reversible quick disassembly, quickly installing the floor during use, enabling the whole floor to be in an raised form, which is convenient to use, and it only needs to be reversely disassembled after use, and structures such as the raised floor boards, the leveling beam, the leveling screws and the like can be recycled for convenience of the next use, which realizes recycling;
2. Compared with the existing assembling method of the raised floor, through the assembling method designed by the present invention, space provided at the bottom of the raised floor to facilitate the arrangement of water pipes, cable routing, etc., which facilitates ventilation under the floor, and keeps dry below the integrated floor and dryness of the floor itself;
3. Through the integrated scheme designed by the present invention, the raised floor is not limited to home use, and can be used in indoor environments such as exhibition halls, hotels and the like. It can also be assembled with wallboards according to the requirements of fabricated buildings, to rapidly form a fabricated house, which greatly saves the time of construction of traditional houses and buildings;
4. Through the integrated solution designed by the present invention, an edge of the raised floor board body structure is processed, so that the raised floor boards can be assembled through lap joint and connection of structures, the raised floor boards are supported through the leveling screws when they are in mutually lap joint for assembly, which can be leveled synchronously, namely, they can be leveled while installing.

Compared with installation of the traditional raised floor, the number of lap joint components can be reduced, thereby reducing transportation cost and further reducing the self-weight of the raised floor, and a multi-foot position of the bottom plate is supported by the leveling screws, so that bearing weight borne by the whole raised floor is evenly distributed on the multiple screws, and so that each screw and each raised floor board is under less pressure, and the phenomenon of deformation and even breakage of the raised floor during use can be avoided.

Figure 1:
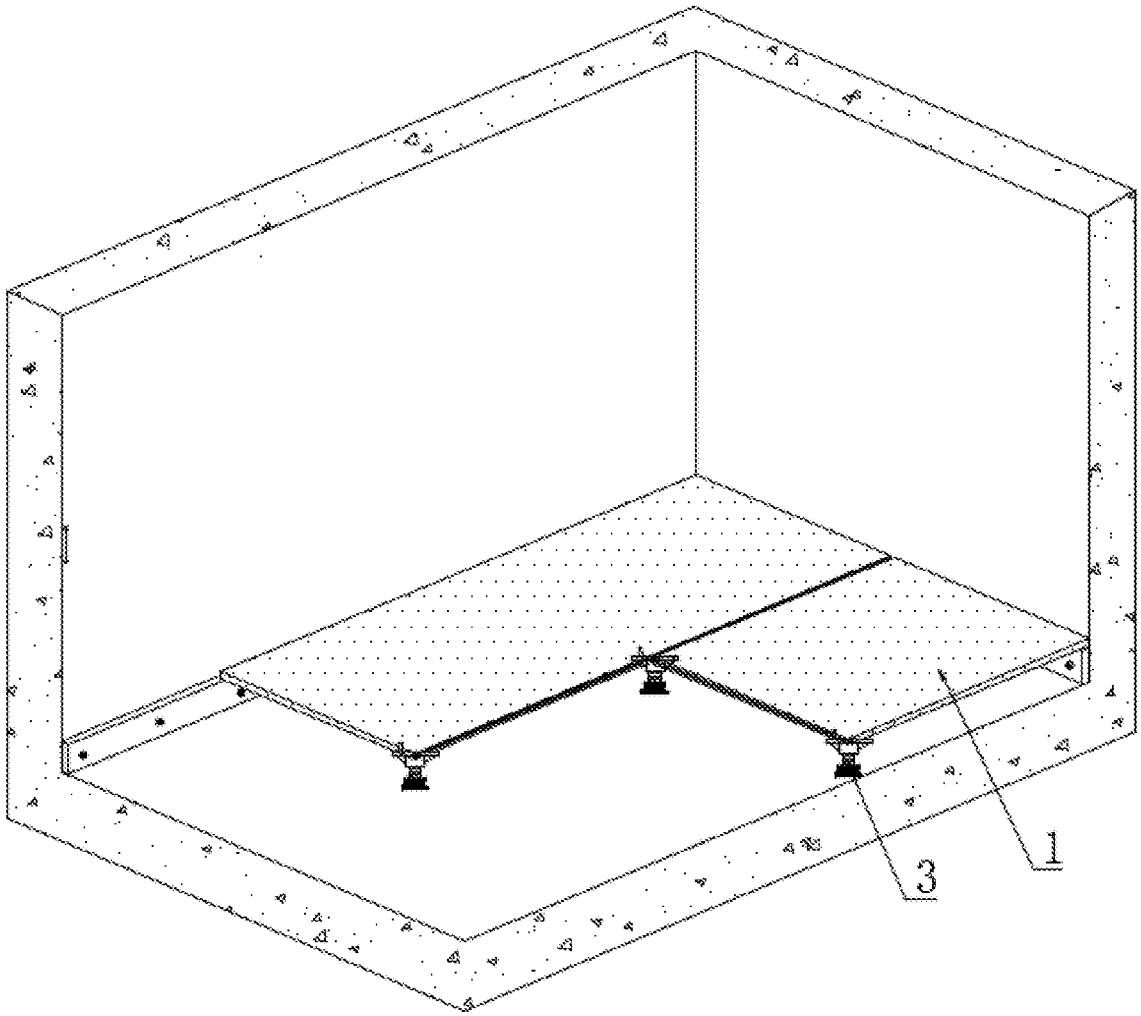
FIG. 1 is a structural diagram of the raised floor when assembled in the wall proposed by the present invention.
Figure 2:
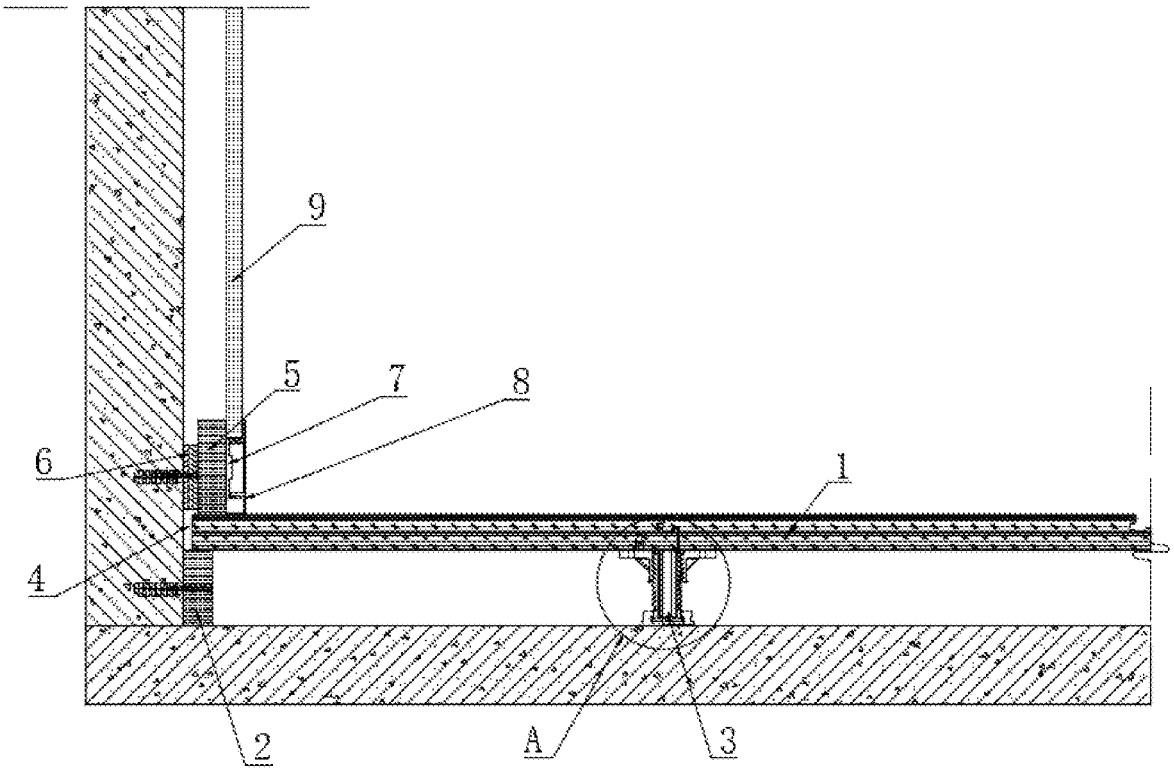
FIG. 2 is a structural diagram of a vertical section of the raised floor when assembled in the wall proposed by the present invention.

In the drawings: 1—raised floor board; 2—leveling beam; 3—leveling screw; 4—reserved expansion joint; 5—frame beam; 6—leveling gasket; 7—skirting buckle; 8—skirting line; 9—wallboard; 11—first lap joint block; 12—second lap joint block; 13—first connecting block; 14—second connecting block; 15—connecting gap chamber; 16—clamping strip; 17—preformed hole; 18—socket; and 31—support plate; 32—support column; 33—support base; 34—internal thread; 35—external thread; 36—insertion rod; and 37—circular truncated cone block.

DETAILED EMBODIMENTS

Hereinafter, technical solutions in the embodiments of the present invention will be clearly and completely described with reference to the drawings in the embodiments of the present invention. It is obvious that the described embodiments are only part of the embodiments of the present invention, but not all of the embodiments. Based on the embodiments in the present invention, all other embodiments obtained by a person of ordinary skill in the art without creative labor shall fall within the protection scope of the present invention.

As shown in FIGS. 1-13, the present embodiment provides a raised floor, which comprises a plurality of raised floor boards 1, wherein a plurality of raised floor boards 1 are assembled and connected to form an integrated floor, an edge of the integrated floor close to the wall is supported by a leveling beam 2, the leveling beam 2 is configured to be fixed on the wall by an expansion screw, and leveling screws 3 are arranged below connecting positions of two adjacent raised floor boards 1, multiple leveling screws 3 are used to support the whole floor at multiple points, so that the force on the floor body is more uniform when in use, and the overall load of the floor can be evenly distributed to the multiple leveling screws 3 to avoid deformation or breakage of the floor, a reserved expansion joint 4 is arranged between the edge of the integrated floor and the wall, and a position above the integrated floor close to the wall is fixedly connected with frame beam 5 by an expansion screw, a leveling gasket 6 is arranged between the frame beam 5 and the wall, skirting buckle 7 is installed on the other side of the frame beam 5; skirting line 8 is arranged on one side of the skirting buckle 7; a wallboard 9 is installed above the skirting buckle 7, so as to build a prefabricated board room with the whole floor as the ground.

Figure 6:
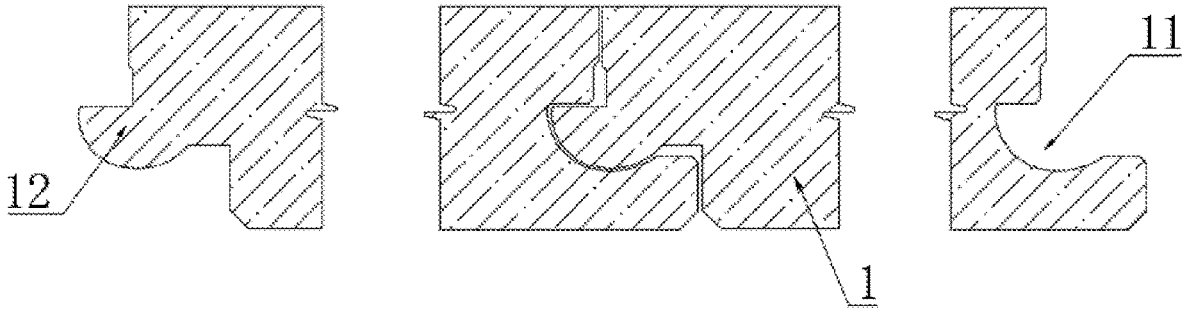
FIG. 6 is a structural diagram of each of the raised floor boards proposed by the present invention when in lap joint in a vertical direction.
Figure 7:
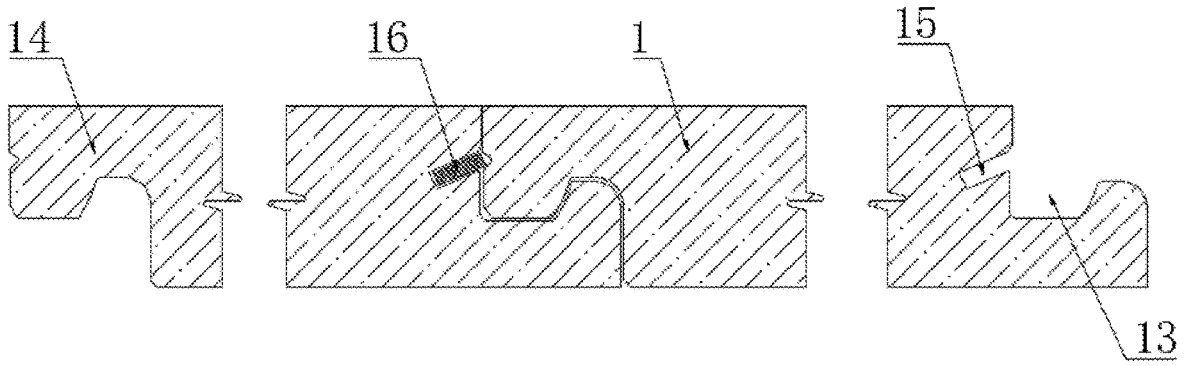
FIG. 7 is a structural diagram of each of the raised floor boards when connected in a horizontal direction proposed by the present invention.
Figure 8:
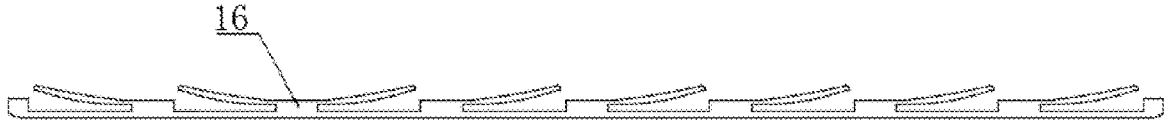
FIG. 8 is a structural diagram of a clamping strip proposed by the present invention.
Figure 9:
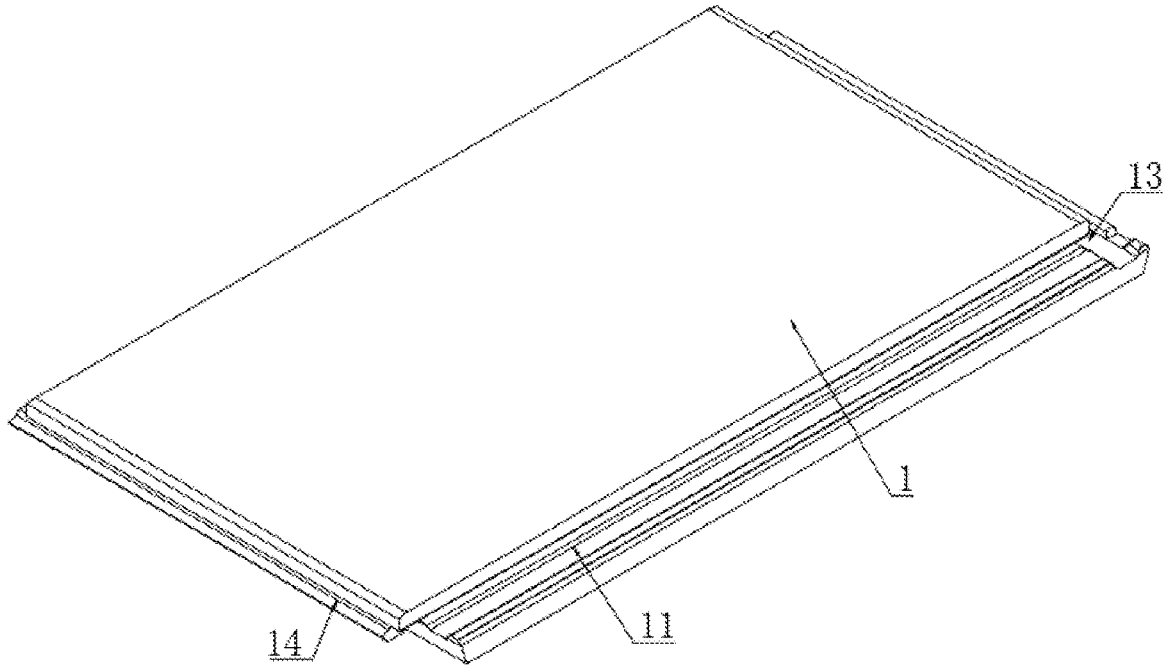
FIG. 9 is a structural diagram of each of the raised floor boards proposed by the present invention from a first perspective when not perforated.
Figure 10:
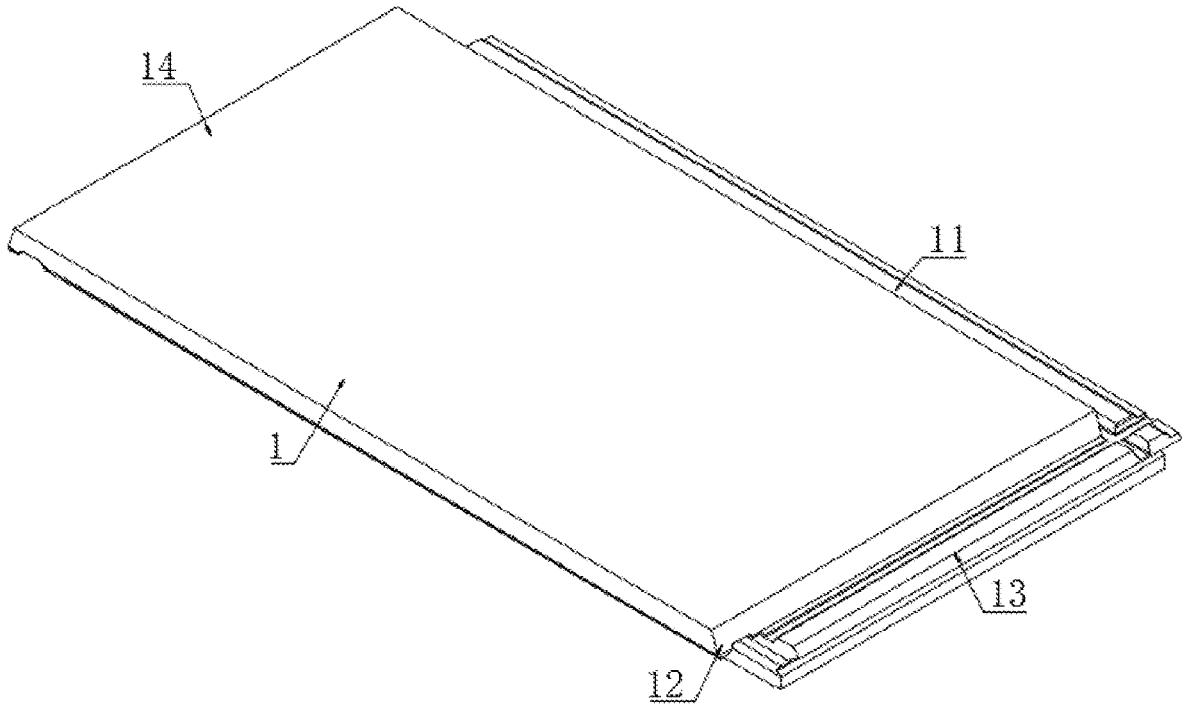
FIG. 10 is a structural diagram of each of the raised floor boards proposed by the present invention from a second perspective when not perforated.
Figure 11:
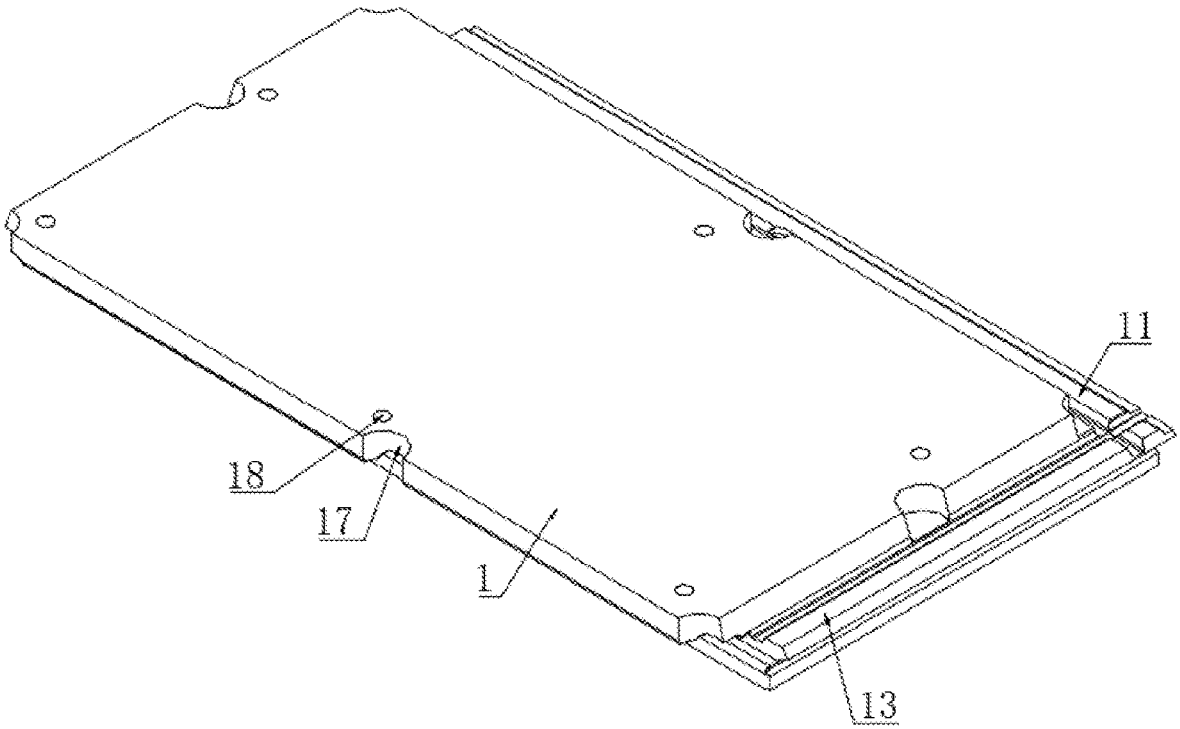
FIG. 11 is a structural diagram of each of the raised floor boards proposed by the present invention from a first perspective when perforated.
Figure 12:
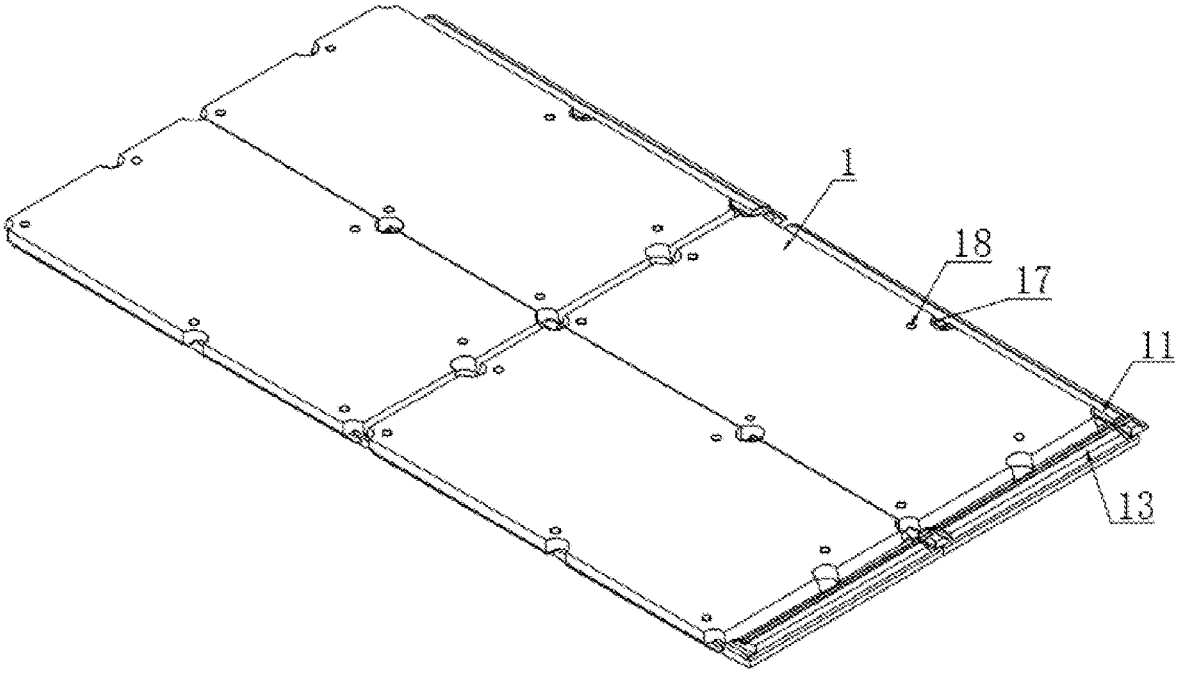
FIG. 12 is a structural diagram of a lower surface of each of the raised floor boards proposed by the present invention when connecting with each other after perforated.
Figure 13:
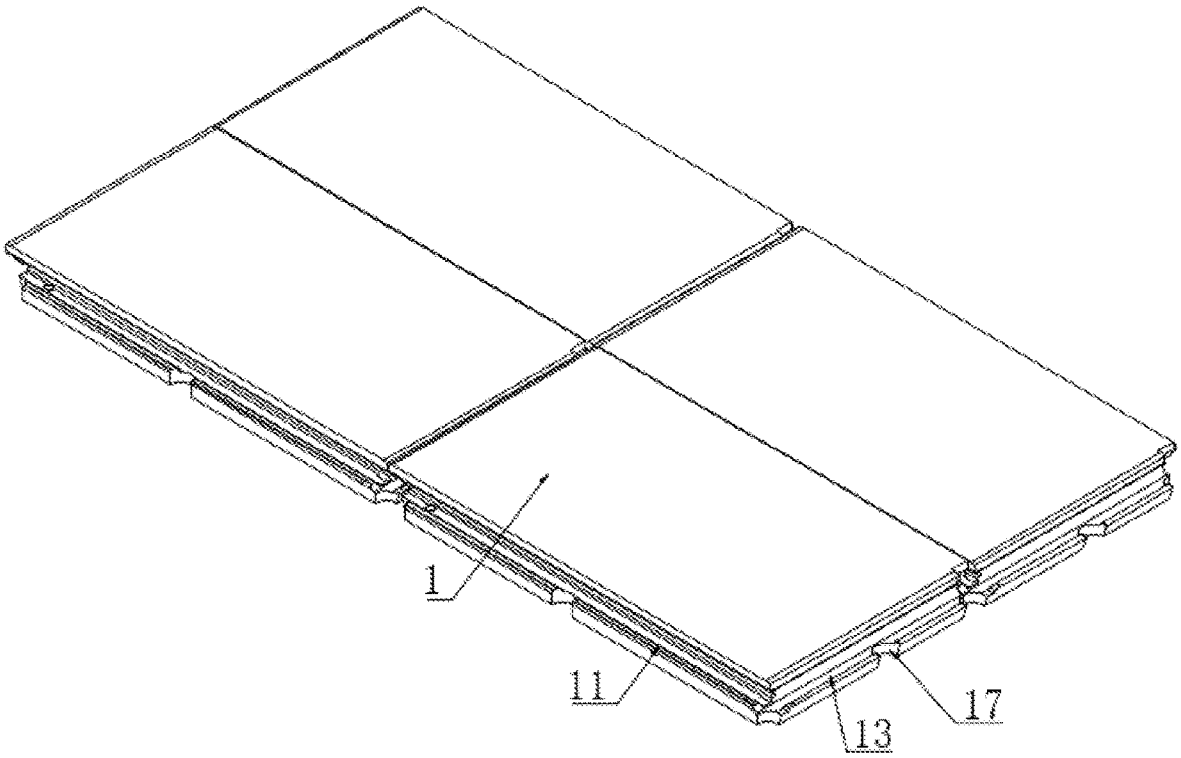
FIG. 13 is a structural diagram of an upper surface of each of the raised floor boards proposed by the present invention when connecting with each other after perforated.

Referring to FIG. 6, the raised floor boards 1 in the embodiment are specifically described, one end portion of each of the raised floor boards 1 in a vertical direction is arranged with a first lap joint block 11, one end of the first lap joint block 11 is provided with a groove with a semi-circular cross-section, namely, a first female groove, the other end portion of each of the raised floor boards 1 in a vertical direction is arranged with a second lap joint block 12, a protruding part of an end portion of the second lap joint block 12 is matched with the groove on the first lap joint block 11, the protruding part of the second lap joint block 12 is a first male groove, the first lap joint block 11 is in a lap joint with the second lap joint block 12, namely, the first male groove and the first female groove can be connected in a locking way, and the same column of the raised floor boards 1 is assembled through the lap joint formed between the first lap joint block 11 and the second lap joint block 12, and can be slidably pulled apart but cannot be pulled apart directly; and Referring to FIG. 7 and FIG. 8, the raised floor boards 1 in the embodiment are specifically described, a first connecting block 13 is arranged at one end portion of each of the raised floor boards 1 in a horizontal direction, a connecting gap chamber 15 is arranged in one side of the first connecting block 13, namely, a second female groove, a second connecting block 14 is arranged at the other end portion of each of the raised floor boards 1 in the horizontal direction, namely, a second male groove, a mounting clamping strip 16 is embedded in the connecting gap chamber 15, and every two adjacent raised floor boards 1 in a same horizontal direction are connected through the first connecting block 13 and the second connecting block 14 which are connected with each other, the clamping strip 16 is put into the connecting gap chamber 15, and then the second connecting block 14 is clamped into the first connecting block 13, and under action of the clamping strip 16, the raised floor boards 1 in the same direction do not shake; the first male groove and the second male groove are arranged towards the wall surface during installation, and then are sequentially installed by adopting aH-shaped assembling method.

Referring to the first lap joint block 11 and the first connecting block 13 in the figures, the raised floor boards 1 in the embodiment are specifically described, positions of the raised floor boards 1 are provided with preformed holes 17 at positions of the leveling screws 3, one side of each of the raised floor boards 1 is provided with two preformed holes 17, and the other side is provided with one preformed hole 17, an outer side of the preformed holes 17 is provided with a plurality of sockets 18, after the raised floor boards 1 are assembled into an integrated floor, the preformed holes 17 at the same positions of the leveling screws 3 form a circular chamber, and the insertion holes 18 on the outer side of the preformed holes 17 are distributed around the circular chamber. In the embodiment, there are two insertion holes 18 on the outer side of each of the preformed holes 17.

Figure 3:
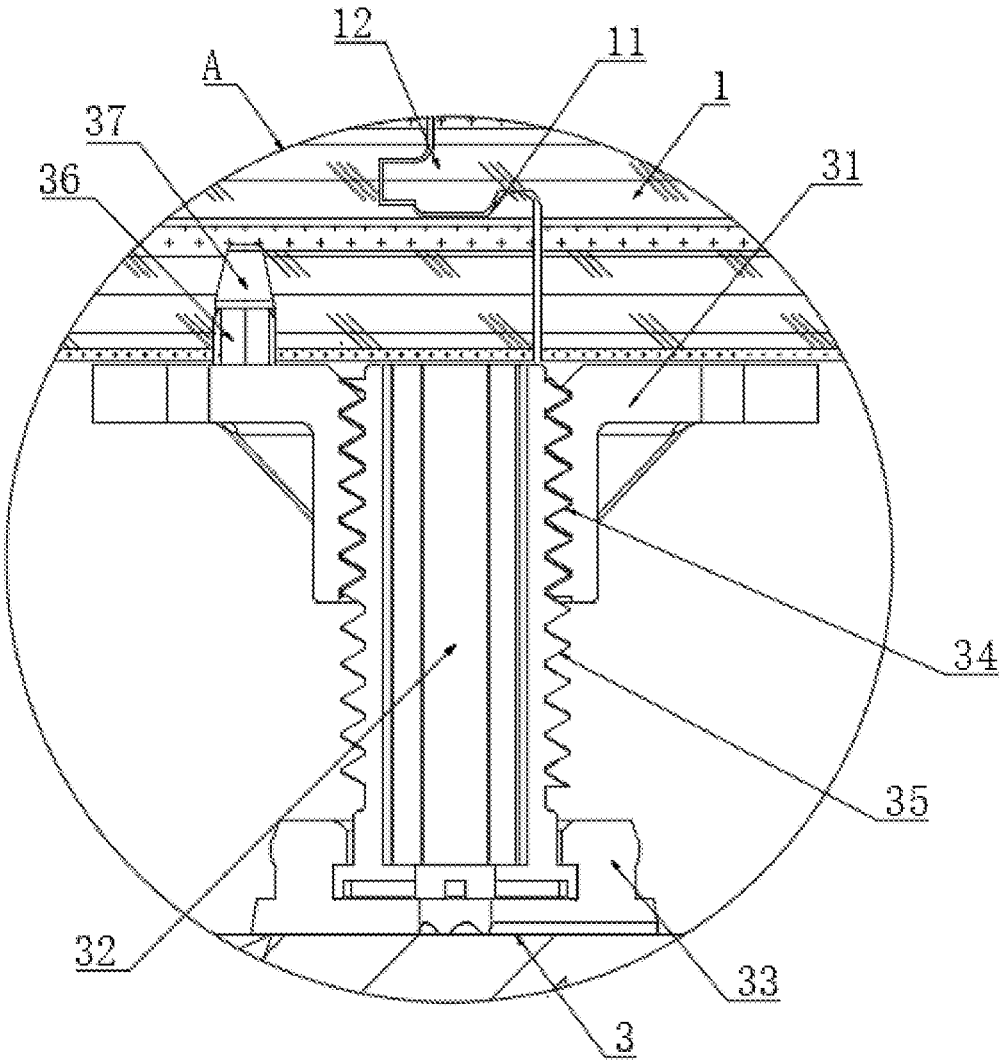
FIG. 3 is an enlarged view of the structure of part A in FIG. 2 of the present invention.
Figure 4:
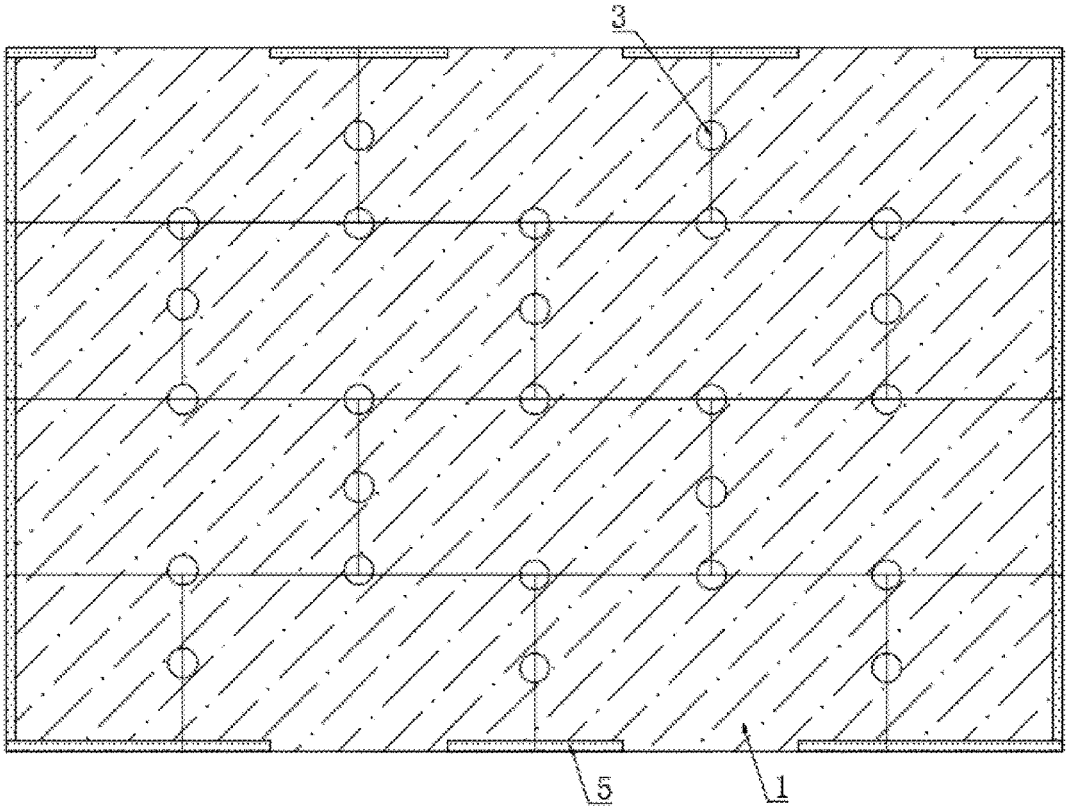
FIG. 4 is a schematic diagram of leveling support leg of the raised floor proposed by the present invention.
Figure 5:
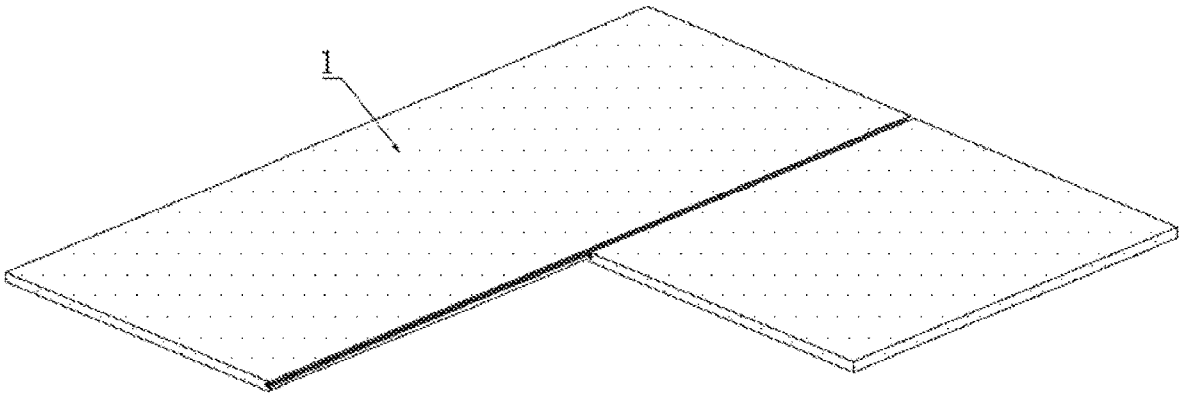
FIG. 5 is a structural diagram of each of the raised floor boards proposed by the present invention when connected.

Referring to FIG. 3, the leveling screws 3 in the embodiment are specifically described, each of the leveling screws comprises a support plate 31, a support column 32 and a support base 33, the support plate 31 is in contact with a bottom wall of each of the raised floor boards 1; a support hole for accommodating the support column 32 is arranged inside the support plate 31 in a penetrating manner, the inner side wall of the support hole is provided with an internal thread 34, an outer side of the support column 32 is provided with an external thread 35, the support column 32 and the support plate 31 are lifted through the internal thread 34 and the external thread 35 which cooperate with each other, an interior of the support column 32 is hollow to form a cross-shaped chamber, a top portion of the cross-shaped chamber is just connected to the circular chamber composed of the preformed holes 17, and the construction personnel can insert the tool into the cross-shaped chamber through the preformed holes 17 to rotate the support column 32, a bottom end of the support column 32 is inserted into the support base 33 to be assembled integrally with the support base 33, a top end of the support plate 31 is connected with an insertion rod 36 at a position corresponding to each of the sockets 18, a top end of the insertion rod 36 is connected with a circular truncated cone block 37, and an outer diameter of the insertion rod 36 is equal to an inner diameter of each of the sockets 18, when the support column 32 rotates, the internal thread 34 is relatively rotated through threaded cooperation, and the insertion rod 36 at the top portion of the support plate 31 is inserted into a bottom end of the raised floor boards 1, so the support plate 31 does not rotate, and the support column 32 rotates below the support plate 31, thereby changing the height of the support plate 31.

Figure 14:
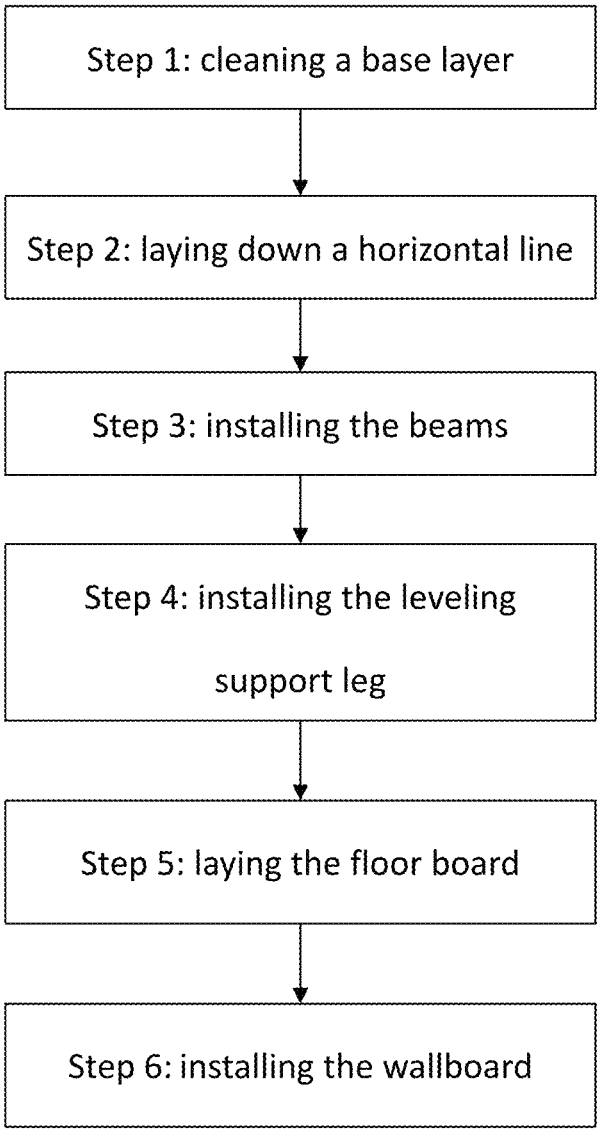
FIG. 14 is a schematic diagram showing an assembling method of the raised floor according to an embodiment of the present invention.

As shown in the first connecting block 13 in FIG. 1, the embodiment further provides a method of assembling a raised floor, as shown in FIG. 14, comprising the following steps:

Step 1: cleaning a base layer: preparing, classifying, placing and keeping clean construction tools, construction materials such as floor boards and a support leg, and simultaneously clearing garbage and dust on the ground, and leveling the ground;

Step 2: laying down a horizontal line: before assembly, planning height of the raised floor according to the environment of the construction site and the use requirement, and then snap-lining through an ink fountain, and forming a horizontal line at an installed position, namely, a floor laying baseline;

Step 3: installing the beams: respectively installing the leveling beam 2 and the frame beam 5, wherein specific steps are as follows:

specific steps of installing the leveling beam 2 in step 3 are as follows: the leveling beam 2 is calibrated by using a laser level gauge to ensure that the horizontal misalignment of the floor over a three meters range does not exceed 0.5 mm, and the misalignment of the whole raised floor does not exceed 2 mm, and the leveling beam 2 is attached to the wall during installation, the bottom end of the leveling beam 2 is in contact with the ground when installing, the top end thereof is flush with the horizontal line, and then the leveling beam 2 is fixed on the wall through the expansion screw, so as to fix the leveling beam 2;

specific steps of installing the frame beam 5 in step 3 are as follows: Step 3-1: installing a leveling gasket 6, first attaching the leveling gasket 6 to the wall according to actual height of skirting line, and then fixing the leveling gasket 6 on the wall through the expansion screw;

Step 3-2: installing the frame beam 5, providing the frame beam 5 according to the height of the skirting line, and placing the frame beam 5 close to the leveling gasket 6 to form a bottom frame of wallboard;

Step 4: installing the leveling support leg: finding positions corresponding to the preformed holes 17 according to the size of the raised floor, and arranging the leveling screws 3 at the positions, so as to fix a support point of the floor board, and adjusting all the leveling screws 3 to the height approximately equal to a top end of the leveling beam 2; and Step 5: laying the floor board, laying the raised floor boards 1 by adopting a T-shaped assembling method, laying the floor board along the floor laying baseline, laying the raised floor boards 1 close to the positions of the leveling beam 2, and leaving the reserved expansion joint 4 so as to prevent the floor from cracking or damaging its integrated structure due to climate and temperature changes, after laying the bottom plate close to the leveling beam 2, laying it continuously with the raised floor boards 1, inserting the insertion rod 36 in the leveling screws 3 into the sockets 18, support and fixing the raised floor boards 1 through the leveling screws 3, and keeping the preformed holes 17 above the leveling screws 3, and finely adjusting the height of the leveling screws 3 with the tools;

Step 6: installing the wallboard, wherein specific installing steps are as follows:

Step 6-1: installing the skirting line 8, attaching the skirting line 8 to the frame beam 5, and installing the skirting line 8 on the frame beam 5 through skirting buckle 7, thereby forming the skirting line of fabricated wallboard; and Step 6-2: installing the wallboard 9, installing the wallboard 9 above the skirting buckle 7, and fixing a bottom end of the wallboard 9 through a gap chamber formed by the skirting line 8 and the frame beam 5.

It should be noted that specific operation of finely adjusting the height of the leveling screws 3 through the tools in step 5 is as follows: twisting the support column 32, and inserting a turning handle with a geometric shape in cross section into the cross chamber inside the support column 32, twisting the turning handle to cause the support column 32 to rotate, and changing the height of the support plate 31 through cooperation of the internal thread 34 and the external thread 35, and finely adjusting the height of the support plate 31 so that the support plate 31 maintains the same height as the top of the leveling beam 2, and keeping the height of the raised floor boards 1 consistent.

Embodiment 2

As shown in FIGS. 1-13, the present embodiment provides a raised floor, which comprises a plurality of raised floor boards 1, wherein a plurality of raised floor boards 1 are assembled and connected to form an integrated floor, an edge of the integrated floor close to the wall is supported by a leveling beam 2, the leveling beam 2 is configured to be fixed on the wall by an expansion screw, and leveling screws 3 are arranged below connecting positions of two adjacent raised floor boards 1, multiple leveling screws 3 are used to support the whole floor at multiple points, so that the force on the floor body is more uniform when in use, and the integrated load of the floor can be evenly distributed to the multiple leveling screws 3 to avoid deformation or breakage of the floor, a reserved expansion joint 4 is arranged between the edge of the integrated floor and the wall, and a position above the integrated floor close to the wall is fixedly connected with frame beam 5 by an expansion screw, a leveling gasket 6 is arranged between the frame beam 5 and the wall, skirting buckle 7 is installed on the other side of the frame beam 5; skirting line 8 is arranged on one side of the skirting buckle 7; a wallboard 9 is installed above the skirting buckle 7, so as to build a prefabricated board room with the whole floor as the ground.

Referring to FIG. 6, the raised floor boards 1 in the embodiment are specifically described, one end portion of each of the raised floor boards 1 in a vertical direction is arranged with a first lap joint block 11, one end of the first lap joint block 11 is provided with a groove with a semi-circular cross-section, namely, a first female groove, the other end portion of each of the raised floor boards 1 in a vertical direction is arranged with a second lap joint block 12, a protruding part of an end portion of the second lap joint block 12 is matched with the groove on the first lap joint block 11, the protruding part of the second lap joint block 12 is a first male groove, the first lap joint block 11 is in a lap joint with the second lap joint block 12, namely, the first male groove and the first female groove can be connected in a locking way, and the same column of the raised floor boards 1 is assembled through the lap joint formed between the first lap joint block 11 and the second lap joint block 12, and can be slidably pulled apart but cannot be pulled apart directly; and Referring to FIG. 7 and FIG. 8, the raised floor boards 1 in the embodiment are specifically described, a first connecting block 13 is arranged at one end portion of each of the raised floor boards 1 in a horizontal direction, a connecting gap chamber 15 is arranged in one side of the first connecting block 13, namely, a second female groove, a second connecting block 14 is arranged at the other end portion of each of the raised floor boards 1 in the horizontal direction, namely, a second male groove, a mounting clamping strip 16 is embedded in the connecting gap chamber 15, and every two adjacent raised floor boards 1 in a same horizontal direction are connected through the first connecting block 13 and the second connecting block 14 which are connected with each other, the clamping strip 16 is put into the connecting gap chamber 15, and then the second connecting block 14 is clamped into the first connecting block 13, and under action of the clamping strip 16, the raised floor boards 1 in the same direction do not shake; the first male groove and the second male groove are arranged towards the wall surface during installation, and then are sequentially installed by adopting a grid-shaped assembling method.

Referring to the first lap joint block 11 and the first connecting block 13 in the figures, the raised floor boards 1 in the embodiment are specifically described, positions of the raised floor boards 1 are provided with preformed holes 17 at positions of the leveling screws 3, one side of each of the raised floor boards 1 is provided with two preformed holes 17, and the other side is provided with one preformed hole 17, an outer side of the preformed holes 17 is provided with a plurality of sockets 18, after the raised floor boards 1 are assembled into an integrated floor, the preformed holes 17 at the same positions of the leveling screws 3 form a circular chamber, and the insertion holes 18 on the outer side of the preformed holes 17 are distributed around the circular chamber. In the embodiment, there are two insertion holes 18 on the outer side of each of the preformed holes 17.

Referring to FIG. 3, the leveling screws 3 in the embodiment are specifically described, each of the leveling screws comprises a support plate 31, a support column 32 and a support base 33, the support plate 31 is in contact with a bottom wall of each of the raised floor boards 1; a support hole for accommodating the support column 32 is arranged inside the support plate 31 in a penetrating manner, the inner side wall of the support hole is provided with an internal thread 34, an outer side of the support column 32 is provided with an external thread 35, the support column 32 and the support plate 31 are lifted through the internal thread 34 and the external thread 35 which cooperate with each other, an interior of the support column 32 is hollow to form a cross-shaped chamber, a top portion of the cross-shaped chamber is just connected to the circular chamber composed of the preformed holes 17, and the construction personnel can insert the tool into the cross-shaped chamber through the preformed holes 17 to rotate the support column 32, a bottom end of the support column 32 is inserted into the support base 33 to be assembled integrally with the support base 33, a top end of the support plate 31 is connected with an insertion rod 36 at a position corresponding to each of the sockets 18, a top end of the insertion rod 36 is connected with a circular truncated cone block 37, and an outer diameter of the insertion rod 36 is equal to an inner diameter of each of the sockets 18, when the support column 32 rotates, the internal thread 34 is relatively rotated through threaded cooperation, and the insertion rod 36 at the top portion of the support plate 31 is inserted into a bottom end of the raised floor boards 1, so the support plate 31 does not rotate, and the support column 32 rotates below the support plate 31, thereby changing the height of the support plate 31.

As shown in the first connecting block 13 in FIG. 1, the embodiment further provides a method of assembling a raised floor, as shown in FIG. 14, comprising the following steps:

Step 1: cleaning a base layer: preparing, classifying, placing and keeping clean construction tools, construction materials such as floor boards and a support leg, and simultaneously clearing garbage and dust on the ground, and leveling the ground;

Step 2: laying down a horizontal line: before assembly, planning height of the raised floor according to the environment of the construction site and the use requirement, and then snap-lining through an ink fountain, and forming a horizontal line at an installed position, namely, a floor laying baseline;

Step 3: installing the beams: respectively installing the leveling beam 2 and the frame beam 5, wherein specific steps are as follows:

specific steps of installing the leveling beam 2 in step 3 are as follows: the leveling beam 2 is calibrated by using a laser level gauge to ensure that the horizontal misalignment of the floor over a three meters range does not exceed 0.5 mm, and the misalignment of the whole raised floor cannot exceed 2 mm, and the leveling beam 2 is attached to the wall during installation, the bottom end of the leveling beam 2 is in contact with the ground when installing, the top end thereof is flush with the horizontal line, and then the leveling beam 2 is fixed on the wall through the expansion screw, so as to fix the leveling beam 2;

specific steps of installing the frame beam 5 in step 3 are as follows: Step 3-1: installing a leveling gasket 6, first attaching the leveling gasket 6 to the wall according to actual height of skirting line, and then fixing the leveling gasket 6 on the wall through the expansion screw;

Step 3-2: installing the frame beam 5, providing the frame beam 5 according to the height of the skirting line, and placing the frame beam 5 close to the leveling gasket 6 to form a bottom frame of wallboard; Step 4: installing the support leg: finding positions corresponding to the preformed holes 17 according to the size of the raised floor, and arranging the leveling screws 3 at the positions, so as to fix a support point of the floor board, and adjusting all the leveling screws 3 to the height approximately equal to a top end of the leveling beam 2; and Step 5: laying the floor board, laying the raised floor boards 1 by adopting a 田-shaped assembling method, laying the floor board along the floor laying baseline, laying the raised floor boards 1 close to the positions of the leveling beam 2, and leaving the reserved expansion joint 4 so as to prevent the floor from cracking or damaging its integrated structure due to climate and temperature changes, after laying the bottom plate close to the leveling beam 2, laying it continuously with the raised floor boards 1, inserting the insertion rod 36 in the leveling screws 3 into the sockets 18, support and fixing the raised floor boards 1 through the leveling screws 3, and keeping the preformed holes 17 above the leveling screws 3, and finely adjusting the height of the leveling screws 3 with the tools;

Step 6: installing the wallboard, wherein specific installing steps are as follows:

Step 6-1: installing the skirting line 8, attaching the skirting line 8 to the frame beam 5, and installing the skirting line 8 on the frame beam 5 through skirting buckle 7, thereby forming the skirting line of fabricated wallboard; and Step 6-2: installing the wallboard 9, installing the wallboard 9 above the skirting buckle 7, and fixing a bottom end of the wallboard 9 through a gap chamber formed by the skirting line 8 and the frame beam 5.

It should be noted that specific operation of finely adjusting the height of the leveling screws 3 through the tools in step 5 is as follows: twisting the support column 32, and inserting a turning handle with a geometric shape in cross section into the cross chamber inside the support column 32, twisting the turning handle to cause the support column 32 to rotate, and changing the height of the support plate 31 through cooperation of the internal thread 34 and the external thread 35, and finely adjusting the height of the support plate 31 so that the support plate 31 maintains the same height as the top of the leveling beam 2, and keeping the height of the raised floor boards 1 consistent.

Last but not least, in the description of the present application, it should be noted that, unless otherwise specified and limited, the terms "installation", "connection with each other" and "connection" are to be understood in a broad sense, which may be mechanical connection or electrical connection, or internal communication between two elements, or direct connection. The terms "upper", "lower", "left", "right" and the like are only used to indicate relative positional relationship. When the absolute position of the described object changes, the relative positional relationship may change;

Secondly, in the drawings of the disclosed embodiments of the present invention, only the structures related to the disclosed embodiments are involved, and other structures can refer to normal designs. Under the condition of no conflict, the same embodiment and different embodiments of the present invention can be combined with each other; and Finally, the above are only preferred embodiments of the present invention and are not intended to limit the present invention. All modifications, equivalents, improvements, etc. that come within the spirit and principles of the present invention shall fall within protection scope of the present invention.

The invention claimed is:

1. A method of assembling a raised floor, comprising the following steps:

step 1: cleaning a base layer: preparing, classifying, placing and keeping clean construction tools, construction materials being floor boards and a support leg, and simultaneously clearing garbage and dust on the ground, and leveling the ground;

step 2: laying down a horizontal line: before assembly, planning height of the raised floor according to an environment of a construction site and a use requirement, and then snap-lining through an ink fountain, and forming the horizontal line at an installed position, namely, a floor laying baseline;

step 3: installing the beams: respectively installing a leveling beam (2) and a frame beam (5);

step 4: installing a leveling support leg: finding positions corresponding to preformed holes (17) according to a size of the raised floor, and arranging leveling screws (3) at the positions, so as to fix a support point of a floor board, and adjusting all the leveling screws (3) to a height approximately equal to a top end of the leveling beam (2); and step 5: laying the floor board, laying the raised floor boards (1), laying the floor board along the floor laying baseline, laying the raised floor boards (1) close to the positions of the leveling beam (2), and leaving the reserved expansion joint (4) so as to prevent the floor board from cracking or damaging integrated structure thereof due to climate and temperature changes, after laying a bottom plate close to the leveling beam (2), laying the bottom plate continuously with the raised floor boards (1), inserting an insertion rod (36) in leveling screws (3) into sockets (18), support and fixing the raised floor boards (1) through the leveling screws (3), and keeping preformed holes (17) above the leveling screws (3), and finely adjusting a height of the leveling screws (3) with the tools.

2. The assembling method according to claim 1, wherein: specific steps of installing the leveling beam (2) in step 3 are as follows:

the leveling beam (2) is calibrated by using a laser level gauge to ensure that horizontal misalignment of the floor over a three meters range does not exceed 0.5 mm, and the misalignment of a whole raised floor does not exceed 2 mm, and the leveling beam (2) is attached to a wall during installation, a bottom end of the leveling beam (2) is in contact with the ground during installing, a top end thereof is flush with the horizontal line, and then the leveling beam (2) is fixed on the wall through an expansion screw, so as to fix the leveling beam (2);

specific steps of installing the frame beam (5) in step 3 are as follows:

step 3-1: installing a leveling gasket (6), first attaching the leveling gasket (6) to the wall according to actual height of skirting line, and then fixing the leveling gasket (6) on the wall through the expansion screw; and step 3-2: installing the frame beam (5), providing the frame beam (5) according to the height of the skirting line, and placing the frame beam (5) close to the leveling gasket (6) to form a bottom frame of wallboard.

3. The assembling method according to claim 1, comprising a step 6: installing the wallboard, wherein specific installing steps are as follows:

step 6-1: installing the skirting line (8), attaching the skirting line (8) to the frame beam (5), and installing the skirting line (8) on the frame beam (5) through skirting buckle (7), thereby forming the skirting line of a wallboard; and step 6-2: installing the wallboard (9), installing the wallboard (9) above the skirting buckle (7), and fixing a bottom end of the wallboard (9) through a gap chamber formed by the skirting line (8) and the frame beam (5).

4. The assembling method according to claim 1, wherein specific operation of finely adjusting the height of the leveling screws (3) through the tools in step 5 is as follows: twisting the support column (32), and inserting a turning handle with a geometric shape in cross section into the cross chamber inside the support column (32), twisting the turning handle to cause the support column (32) to rotate, and changing the height of the support plate (31) through cooperation of an internal thread (34) and an external thread (35), and finely adjusting the height of the support plate (31) so that the support plate (31) maintains the same height as a top of the leveling beam (2), and keeping the height of the raised floor boards (1) consistent.

* * * * *